United States Patent [19]

Antonov et al.

[11] 4,357,816

[45] Nov. 9, 1982

[54] METHOD OF PRODUCING HOLLOW ARTICLES BY DEEP DRAWING AND PRESS FOR EFFECTING SAME

[76] Inventors: Evgeny A. Antonov, ulitsa Svobody, 6, kv. 27; Anatoly S. Matveev, ulitsa Frunze, 90, kv. 45; Nikolai I. Nikonov, ulitsa Voroshilova, 20, kv. 19; Boris N. Leonov, ulitsa Kirova, 17, kv. 16; Anatoly V. Razhev, ulitsa 9 Maya, 2, kv. 71; Vyacheslav I. Prokofiev, ulitsa Svobody, 19, kv. 75, all of, Rybinsk Yaroslavskoi oblasti, U.S.S.R.

[21] Appl. No.: 201,071

[22] PCT Filed: Oct. 30, 1979

[86] PCT No.: PCT/SU79/00103

§ 371 Date: Aug. 21, 1980

§ 102(e) Date: Aug. 15, 1980

[87] PCT Pub. No.: WO80/01253

PCT Pub. Date: Jun. 26, 1980

[51] Int. Cl.[3] ..... B21D 39/08

[52] U.S. Cl. ..... 72/57; 72/347; 72/453.02

[58] Field of Search ..... 72/347, 348, 349, 57, 72/453.02

[56] References Cited

U.S. PATENT DOCUMENTS 3,452,566 7/1969 Arche et al. ..... 72/347 X
3,495,433 2/1970 Fuchs, Jr. ..... 72/347

FOREIGN PATENT DOCUMENTS 344289 4/1972 Sweden .
419279 9/1974 U.S.S.R. .

*Primary Examiner*—Leon Gilden
*Attorney, Agent, or Firm*—Fleit & Jacobson

[57] ABSTRACT

A press for manufacturing hollow articles by deep drawing comprising a high pressure vessel (1) accommodating a die (3) with a punch (4). A blank (14) is accommodated in an annular high pressure chamber (16) communicating with a high pressure chamber (19) of an intensifier (20). The press also comprises a device (27) for regulating pressure in the annular chamber to control pressure acting upon the peripheral portion of a blank in accordance with a preset law, an appliance (39) for setting pressure in the annular chamber is made in the form of a tracer whose profile is equidistant with the curve characterizing the alteration of pressure in the annular chamber (16).

5 Claims, 2 Drawing Figures

METHOD OF PRODUCING HOLLOW ARTICLES BY DEEP DRAWING AND PRESS FOR EFFECTING SAME

BACKGROUND OF THE INVENTION

The present invention relates to metal working, and more particularly, to a method of producing hollow articles by deep drawing and a press for effecting same.

A better quality of hollow articles produced by deep drawing along with the provision of higly efficient equipment is quite essential where drawing of articles is effected with radial head pressure acting on the flanged portion of a blank.

There is known in the art a method of deep drawing of sheet metals wherein rigid pushers are used to act on the peripheral part of the blank in a manner to create radial head pressure effecting the flanged part of the blank (USSR Inventor's Certificate No. 419,279, published in Discoveries, Inventions, Industrial Designs and Trade Marks Bulletin No. 10, 1974). In the process of drawing, the rigid pushers interact with the blank through their narrow sections which causes uneven distribution of head pressure over the peripheral portion of the blank. This, in turn, makes it impossible to increase the drawing coefficient K, which is determined by the relation of the blank radius $R_i$ to the punch radius $R_o$. In addition, the method described above fails to provide radial head pressure required to action the peripheral part of the blank in the drawing direction. As a result, the articles thus produced suffer from poor quality.

There is also known in the art a method of producing hollow articles by deep drawing, which resides in that the central portion of a blank positioned on a die is hermetically separated from the peripheral portion of the same blank, whereupon a high-pressure fluid is used to act upon the butt end of the blank peripheral portion, with the blank being drawn through the agency of a rigid punch (U.S. Pat. No. 3,495,433; cl. 72-347, published 1977). In the process of drawing, the pressure applied to the peripheral portion of the blank is brought down. This occurs due to a decrease in the diameter of the blank peripheral portion. However, at the initial stage of drawing the pressure tends to crowd the metal into a shape without the punch participation, which results in an undesirable dome-formation in the central portion of the blank and, consequently, in a higher percentage of defective products.

The prior art teaches a press for the manufacture of hollow articles by deep drawing, which comprises a high-pressure vessel accommodating a die with a punch in rigid connection with a piston of a punch-actuating hydraulic cylinder, and a clamp formed with a collar provided to ensure hermetic separation of the blank central portion from its peripheral portion. The clamp is located opposite a drawing rib of the die whose end surface forms, together with the end surface of the clamp, a high-pressure annular chamber which accommodates the blank peripheral portion and communicates with a high-pressure chamber of an intensifier (U.S. Pat. No. 3,495,433; Cl. 72-347, published 1977).

The die is formed with a plurality of vertical grooves intended to communicate the annular high-pressure chamber with a pressure source. In its upper part, the die is fitted with a channel intended to communicate the die cavity through a return valve with the cylinder chamber into which a fluid, delivered along a line, is discharged. The cylinder is brought in contact with the high-pressure vessel to form an annular chamber wherein hydrostatic pressure of fluid is created to act on the peripheral portion of the sheet metal blank in the process of drawing.

This high hydrostatic pressure is not adjusted in the process of drawing, its value at the beginning and at the end of the drawing operation being very much in excess of a specified value. As a result, the formation of the peripheral part of the blank is effected spontaneously at the initial stage of drawing; thin-walled articles tend to wrinkle and thick-walled articles develop dents or hollows on their surfaces at the end of the drawing process.

SUMMARY OF THE INVENTION

The invention has as its aim the provision of a method and a press for producing hollow articles by deep drawing, wherein an alteration of pressure acting on the peripheral portion of a blank in the process of drawing in accordance with a given law will make it possible to improve the quality of articles being drawn.

This aim is attained in a method of producing hollow articles by deep drawing, consisting in that the central portion of a blank positioned on a die is hermetically separated from the blank peripheral portion, the butt end of the blank peripheral portion is acted upon by a high-pressure fluid, and the drawing of the blank is effected by means of a rigid punch, wherein, according to the invention, the pressure q is altered in accordance with the following law:

$$q = \beta\sigma_s \cdot \ln \frac{R_i}{R_o + t} - \sigma_1,$$

where $\beta$ is the coefficient accounting for the influence of an average main stress of the blank material;

$\sigma$ is the yield stress of the blank material;

$R_i$ is the blank running radius;

$R_o$ is the punch radius;

t is the wall-thickness of a finished product;

$\sigma$ is the stress on the interior edge of the peripheral portion of a blank.

The aim of the invention is also accomplished by the provision of a press for carrying into effect the method of the invention, comprising a high-pressure vessel accommodating a die with a punch in rigid connection with a piston of a punch-actuating hydraulic cylinder, and a clamp formed with a collar for hermetic separation of the central portion of a blank from its peripheral portion and positioned opposite a drawing rib of the die whose end surface forms, together with the end surface of the clamp and with the inner surface of the high-pressure vessel, an annular high-pressure chamber which accommodates the peripheral portion of the blank and communicates with a high-pressure chamber of an intensifier according to the invention, there is provided a pressure regulator arranged in the annular chamber and incorporating a hydraulic cylinder with a piston, the piston cavity of which is brought in communication with a rod cavity of the punch-actuating hydraulic cylinder, an appliance for setting pressure in the annular high-pressure chamber, altered in accordance with a specified law, said appliance being fixed on the piston rod, a regulator of pressure created in the high-pressure chamber of the intensifier and acting on the peripheral portion of the blank, said pressure regulator having its sensitive element in contact with the pressure setting appliance.

It is advantageous for the press to be provided with a means for adjusting the travelling speed of the pressure setting appliance relative to the punch having a hydraulic motor and a hydraulic pump with an adjustable rate of delivery, the former and the latter being mounted on a common shaft and respectively brought in communication with the rod and piston cavities of the punch-actuating hydraulic cylinder and of a hydraulic cylinder for actuating the pressure setting appliance.

It is preferable that the pressure setting appliance be provided in the form of a tracer with the profile thereof being equidistant with the curve characterizing the alteration of pressure in the annular high-pressure chamber.

With the method of the invention it becomes feasible to control, in accordance with a preset law, a fluid high pressure acting on the peripheral portion of a blank in the direction of its drawing. This eliminates the possibility for self-drawing of the blank without participation of the punch, effected only under the action of the radial hydrostatic head created by the high-pressure fluid. In other words, any uncontrolled operation in the formation of the blank bottom portion is excepted to thereby allow better quality of the finished product.

Furthermore, the method of the invention allows for the application of fluid pressure to be used at optimal values at each stage of the drawing operation, making it possible to control magnitudes of stresses acting in the drawn portion of the blank or, in other words, to gain control over the quality of finished product. In addition, the method of the invention is carried out in a manner permitting the finished product to be prevented from "shooting" into the die cavity at the end of the drawing process, which causes wrinkling of the thin-walled products and formation of dents on the surface of thick-walled articles. In other words, it becomes possible to ensure high quality of the product being drawn.

The fact that the press of the invention is equipped with a device for regulating high pressure of fluid, acting on the peripheral part of the blank in the process of its drawing, makes it possible to improve the quality of finished product. Owing to the fact that the high-pressure regulating assembly is equipped with a removable tracer, whose contour is equidistant with the curve $$q = \beta \cdot \sigma_s \ln \frac{R_i}{R_o + t} - \sigma_1,$$

optimal fluid pressures can be applied to the peripheral portion of the blank. This, in turn, will preclude spontaneous crowding of the blank flange without participation of the punch at the initial stage of the drawing operation, as well as prevent the finished product from being "shot" into the die cavity at the end of the drawing process. Thus, good conditions are created to permit appropriate formation of the peripheral portion of the blank and to prevent wrinkling or the formation of dents or scratches on the finished product.

The provision of the speed regulator intended to control the travelling speed of the tracer, functioning to preset a law of alteration of high fluid pressure acting on the blank peripheral portion relative to the punch, makes it possible to improve the quality of technologically similar articles, that is of those manufactured from one and the same material, having the same drawing coefficient K, through the use of one and the same tracer.

BRIEF DESCRIPTION OF THE DRAWINGS

The invention will now be described, by way of example only, with reference to the accompanying drawings, in which.

Figure 1:
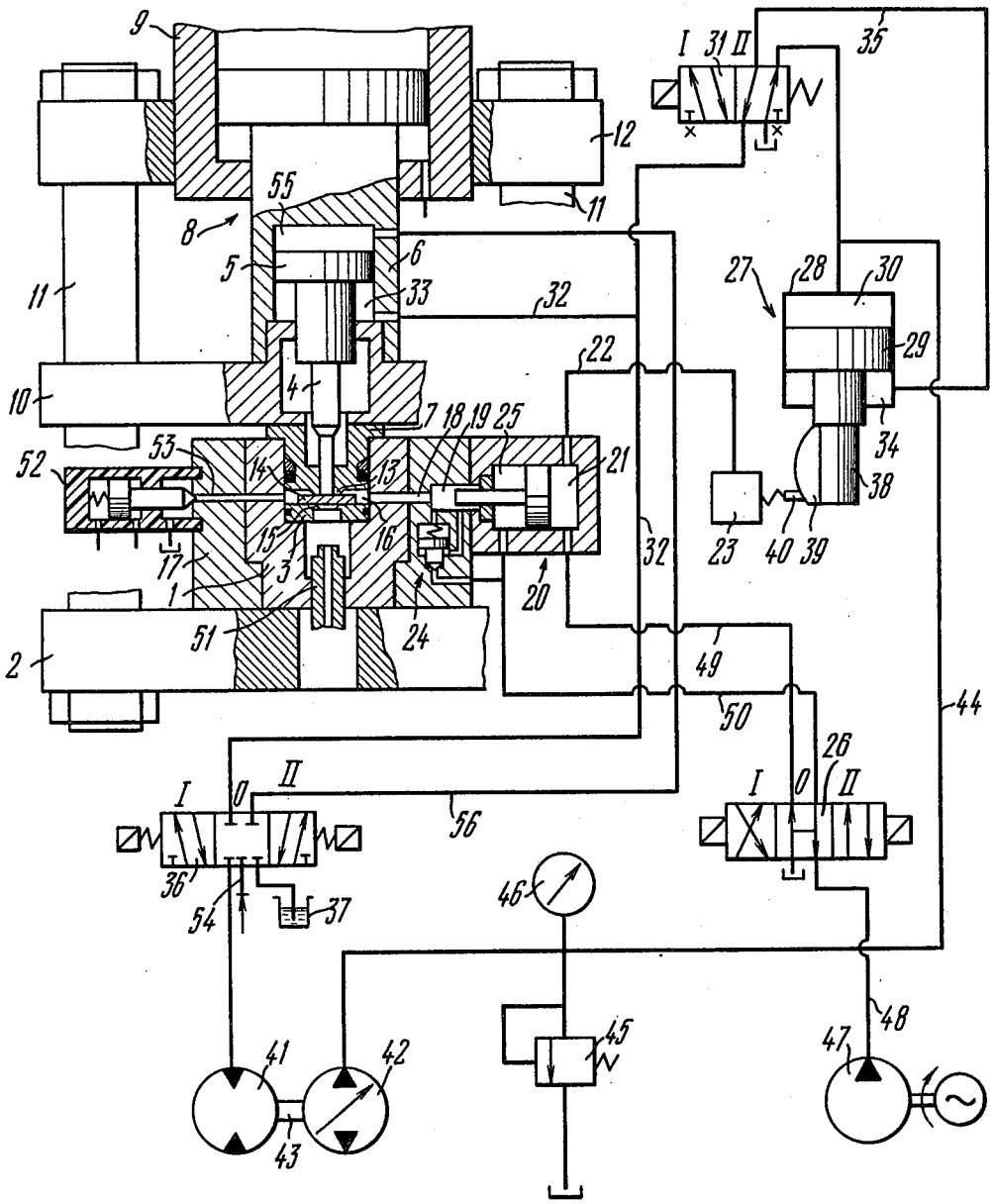
FIG. 1 is a hydromechanical diagramme of a press for the production of hollow articles by deep drawing, according to the invention.

Referring now to the drawings, and to FIG. 1 in particular, there is shown therein a press for carrying into dffect the method of the invention for producing hollow articles by deep drawing, which comprises a high-pressure vessel 1 mounted on a table 2. The vessel 1 accommodates a die 3 and a punch 4 which is rigidly connected with a piston 5 of a punch-actuating hydraulic cylinder 6. The punch 4 is positioned in an axial opening of a clamp 7. The punch-actuating hydraulic cylinder 6 is located in a rod 8 of a hydraulic cylinder 9 for actuating a sliding crosspiece 10. The crosspiece 10 is slidable along guides 11 and is intended for moving the clamp 7. There is also provided a stationary crosspiece 12 which is rigidly fixed on the guides 11 and accommodates the hydraulic cylinder 9.

The clamp 7 has its end face, presented to the die 3, formed with an annular collar 13 intended for hermetic separation of the central portion of a blank 14 from its peripheral portion disposed opposite a drawing rib 15 of the die 3.

The end surface of the die 3 forms, together with the end surface of the clamp 7 and the interior face of the high-pressure vessel 1, an annular high-pressure chamber 16. The vessel 1 has a pressed-on shell 17. The chamber 16 communicates through a channel 18 with a high-pressure chamber 19 of an intensifier 20. The intensifier 20 has its low-pressure chamber 21 brought in communication through a pipeline 22 with a pressure regulator 23.

The chamber 19 communicates with a return valve 24 for blowing-through the annular chamber 16. The valve 24 has its input brought in communication with a rod cavity 25 of the intensifier 20 and with a hydraulic distributor 26.

The press of the invention also comprises a device 27 for regulating pressure in the high-pressure chamber of the intensifier 20 which device incorporates a hydraulic cylinder 28 with a piston 29. A piston cavity 30 of the hydraulic cylinder 28 communicates through a hydraulic distributor 31 and a pipeline 32 with a rod cavity 33 of the punch-actuating hydraulic cylinder 6. A rod cavity 34 of the hydraulic cylinder 28 communicates through a pipeline 35, the distributor 31, the pipeline 32 and a distributor 36 with a tank 37. Fixed on a rod 38 of the hydraulic cylinder 28 is an appliance 39 for setting pressure in the annular high-pressure chamber 16, which pressure is subjected to alteration in accordance with a prescribed law. A sensitive element 40 of the pressure regulator 23 is brought in contact with the profiled surface of the pressure setting appliance 39.

The press is also provided with an appliance for regulating the travelling speed of the pressure setting appliance 39 relative to the punch 4. This speed regulator makes it possible to manufacture articles from one and the same material, having the same drawing coefficient K, but varying in length and diameter, without replacing the pressure setting appliance 39. The speed regulator includes a hydraulic motor 41 and a hydraulic pump 42 with an adjustable rate of delivery, the former and the latter being mounted on a common shaft 43. The hydraulic motor 41 is brought in communication through the hydraulic distributor 36, pipeline 32 with the rod cavity 33 of the hydraulic cylinder 6; and the hydraulic pump 42 communicates through a pipeline 44 with the piston cavity 30 of the hydraulic cylinder 28. There are provided a valve 45 and a pressure gauge 46, which are intended for setting the hydraulic pump 42 to a requisite pressure.

The intensifier 20 is operated by means of a hydraulic pump 47 delivering oil along pipelines 48, 49, 50. The finished product is withdrawn from the die 3 by means of a pusher 51 whose movement is synchronized with that of the sliding crosspiece 10. The pusher 51 is formed with an axial passage along which the oil under pressure is delivered to the die cavity. The oil pressure in this cavity is required to enable the drawing of articles from materials having low plasticity. There is provided a valve 52 intended to remove the air from the chamber 16 prior to drawing, which valve communicates through a passage 53 with the chamber 16.

The distributor 36, connected to a discharge line 54, is brought in communication with a piston cavity 55 of the hydraulic cylinder 6 through a pipeline 56.

Figure 2:
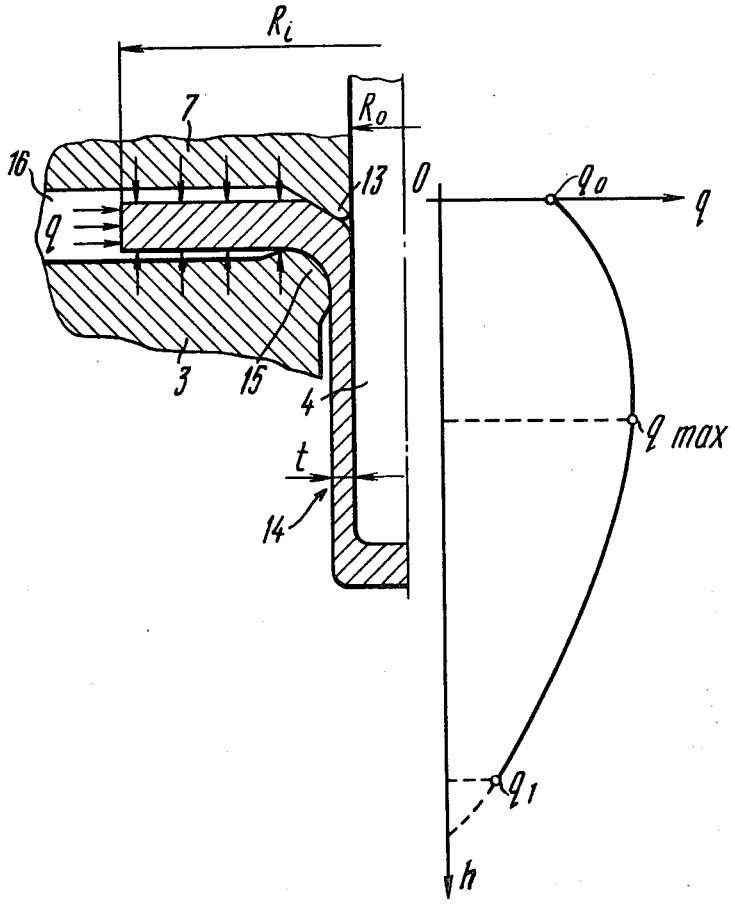
FIG. 2 shows an intermediate stage of drawing a hollow article from a flat blank with radial hydrostatic head pressure being applied to the blank peripheral portion, and a chart depicting an alteration of pressure corresponding to the profile of a tracer intended for setting a law of the fluid pressure alteration due to take place in the direction of drawing, according to the invention.

In the preferred embodiment of the invention, the pressure setting appliance 39 is provided in the form of a removable tracer with the profile thereof being equidistant to the curve characterizing the alteration of pressure in the annular high-pressure chamber 16. For better understanding of the invention, there is shown in the right-hand part of FIG. 2 a chart depicting an alteration of pressure corresponding to the tracer contour and constructed in coordinates where the abscissa is the pressure q, and the ordinate is the value h of the working stroke of the punch 4. Shown in the left-hand part of FIG. 2 is an intermediate stage of the blank 14 with the indication of pressure q acting on the peripheral portion of the blank 14.

The scale along the Y-axis is selected with regard to the coefficient $K_1$ of proportionality between the travelling speeds of the pistons 5 (FIG. 1) and 29. The tracer contour has three characteristic points $q_o$ (FIG. 2), $q_{max}$ and $q_1$. The point $q_o$ is given to determine the value of pressure applied to the peripheral portion of the blank 14 prior to the working stroke of the punch. Here the pressure value is selected to be below that at which occurs self-drawing of the blank 14, resulting in swelling of the blank central portion. The point $q_{max}$ is given to characterize the value of pressure applied to the peripheral portion of the blank 14 on attaining the critical drawing coefficient K characterized by maximum stresses acting on the inner edge of the flange of the blank 14 being drawn. The point $q_1$ determines the pressure at which it becomes possible to prevent "the shooting" of the finished product into the cavity of the die 3 at the end of drawing.

The press according to the invention for producing hollow articles by deep drawing operates in the following manner.

Originally, the clamp 7 (FIG. 1) and the sliding crosspiece 10 with the piston of the hydraulic cylinder 9 are found in the extreme upper position. The clamp 7 is brought out of the high-pressure vessel 1. The piston 5 with the punch 4, as well as the rod 38 with the tracer 39, occupy extreme upper positions. The piston of the intensifier 20 occupies an extreme right-hand position, the valve 52 is open, and the pusher 51 occupies extreme lower position.

The blank 14 is introduced into the open cavity of the high-pressure vessel 1 and is then mounted on the die 3. With the press put in operation, the press control hydraulic circuit (not shown in FIG. 1) operates to enable downward movement of the piston of the hydraulic cylinder 9 with the crosspiece 10 and clamp 7. As the clamp 7 goes down, it enters the cavity of the high-pressure vessel 1. The annular collar 13 of the clamp 7 is brought in contact with the blank 14, thereby providing for reliable hermetic separation of the central portion of the blank 14 from its peripheral portion. This results in the formation of the high-pressure chamber 16. Thereafter, the hydraulic distributor 26 occupies position 11 at which the pipeline 48 is brought in communication with the pipeline 50, and the pipeline 49 with an outlet line. The fluid delivered by the pump 47 is passed through the valve 24 to the high-pressure chamber 19 of the intensifier 20 and thence along the channel 18 to the chamber 16, wherein is located the peripheral portion of the blank 14, thus forcing out the air therefrom through the open valve 52.

After a certain period of time, preset by a time relay (not shown in FIG. 1), the valve 52 is closed, the distributor 26 occupying position 1. At this moment, the pipeline 48 is brought in communication with the pipeline 49, and the pipeline 50 with an outlet line, whereupon the fluid delivered by the pump 47 is passed to the piston cavity 21 of the intensifier 20.

As the piston of the intensifier 20 travels in the left-hand direction, it creates high pressure q of the fluid disposed in the chamber 16, which pressure acts on the peripheral portion of the blank 14. The value of this pressure is determined by the position of the tracer and of the sensitive element 40 of the pressure regulator 23, and does not exceed the pressure permitting self-drawing of the blank 14.

Then ensues the process of drawing a hollow article. The distributor 36 occupies position II at which the pipeline 54 is brought in communication with the pipeline 56, and the pipeline 32 with the hydraulic motor 41. The distributor 31 occupies position 1 at which the pipeline 35 is disconnected from the pipeline 32 and brought in communication with an outlet line. As a result, the piston cavity 55 of the hydraulic cylinder 6 is brought in communication with the pipeline 54. The fluid from the rod cavity 33 of the hydraulic cylinder 6 is passed through the distributor 36 to the hydraulic motor 41 which sets in rotation the shaft 43 of the pump 42 with an adjustable rate of delivery. The pump 42 is brought in communication through the pipeline 44 with the piston cavity 30 of the hydraulic cylinder 28. From the rod cavity 34 of the hydraulic cylinder 28, the fluid is passed through the distributor 31 to an outlet line. The rod 38 of the piston 29 moves downward together with the tracer. On interacting with the sensitive element 40 of the pressure regulator 23, the tracer functions to alter the fluid pressure in the chamber 16, acting on the peripheral portion of the blank 14 in accordance with the following law:

$$q = \beta\sigma_s \cdot \ln \frac{R_i}{R_o + t} - \sigma_1,$$

where $\beta$ is the coefficient accountant for the influence of an average main stress of the blank material;

$\sigma$ is the yield stress of the blank material;

$R_i$ is the blank running radius;

$R_o$ is the punch radius;

t is the wall-thickness of a finished product;

$\sigma_1$ is the stress acting on the interior edge of the peripheral portion of a blank.

The pressure alteration law is determined by the tracer contour and allows for optimal pressure value to be attained at each stage of the drawing operation.

By adjusting the delivery rate of the pump 42, functioning to deliver oil to the piston cavity 30 of the hydraulic cylinder 28, it becomes possible to control relative speed of travelling of the punch 4 and that of the rod 38 carrying the pressure setter 39. By virtue of this factor the tracer contour is permitted to be either "stretched" or "contracted" along the axis h (FIG. 2) at constant coordinate of the point $q_o$ given to determine initial pressure acting on the peripheral portion of the blank 14 at the initial stage of drawing. Thus, the press can be successfully used for the production of technologically similar articles, i.e. of the articles made of one and the same material, having the same drawing coefficient K, and making use of one and the same tracer.

Towards the end of the operating cycle, with the drawing operation completed, the distributor 26 is shifted into position II, whereupon high fluid pressure $q_1$ in the chamber 16 is brought down to the value of pressure gained by the pump 47, with the piston of the intensifier 20 being returned to its original position. Then, the sliding crosspiece 10 is lifted together with the clamp 7 to upper position. The distributor 36 is shifted into position 1 at which the pipeline 54 is brought in communication with the pipeline 32, and the pipeline 56 with the discharge tank 37. As this happens, the piston 5 is found in its upper original position. The distributor 31 occupies position II functioning to return the piston 29 with the pressure setting appliance 39 to original position.

On completion of the drawing cycle, the pusher 51 travels in the upward direction, thereby forcing out a finished product from the cavity of the die 3.

INDUSTRIAL APPLICABILITY

A press for manufacturing hollow articles by deep drawing is used mainly in the metal working industry for the fabrication of deep cylindrical cups with a wide flange or without it, from a flat or predrawn blank of any rectangular or irregular shape (circle, oval, diamond, square).

The invention is well suited to the manufacture of shells, sleeves and protective screens.

We claim:

1. A press for producing hollow articles by deep drawing of a blank comprising a high-pressure vessel, a die accommodated in said high pressure vessel and having a drawing rib engageable with a blank, a punch accommodated in said high pressure vessel, a punch-actuating hydraulic cylinder having a piston rigidly connected with said punch, a clamp formed with a collar for hermetic separation of a central portion of the blank from a peripheral portion and positioned opposite the drawing rib of the die, the die having an end surface which forms, together with an end surface of the clamp and with an inner surface of the high-pressure vessel, an annular high-pressure chamber wherein is positioned the peripheral portion of the blank, a high-pressure chamber of an intensifier communicating with said annular high-pressure chamber, a pressure regulator for controlling pressure in the annular chamber and incorporating a second hydraulic cylinder and a second piston whose cavity is brought in communication with a rod cavity of the punch-actuating hydraulic cylinder, an appliance for setting pressure in the annular high-pressure chamber, said appliance being fixed on a rod of the second piston, and a regulator of pressure created in the high-pressure chamber of the intensifier and acting on the peripheral portion of the blank, said pressure regulator having a sensitive element brought in contact with the pressure setting appliance whereby the pressure in the annular high pressure chamber is varied in accordance with movement of said punch to thereby control the quality of the drawn blanks.

2. A press as claimed in claim 1, characterized in that it comprises a means for adjusting the travelling speed of the pressure setting appliance relative to the punch having a hydraulic motor and a hydraulic pump with adjustable rate of delivery, the former and the latter being mounted on a common shaft and brought respectively in communication with the rod and piston cavities of the punch-actuating hydraulic cylinder and of a hydraulic cylinder for actuating the pressure setting appliance.

3. A press as claimed in one of claims 1 or 2, characterized in that the pressure setting appliance is provided in the form of a tracer whose profile is equidistant with the curve characterizing the alteration of pressure in the annular high-pressure chamber.

4. A press as claimed in one of claims 1 or 2, wherein the appliance for setting pressure is shaped to alter pressure q in accordance with the following:

$$q = \beta\ \sigma_s \ln \frac{R_i}{R_o + t} - \sigma_1,$$

where $\beta$ is the coefficient accounting for the influence of an average main stress of the blank material;

$\sigma_s$ is the yield stress of the blank material;

$R_i$ is the blank running radius;

$R_o$ is the punch radius;

t is the wall-thickness of a finished product;

$\sigma_1$ is the stress on the inner edge of the peripheral portion of a blank.

5. A press as claimed in claim 3, wherein the appliance for setting pressure is shaped to alter pressure q in accordance with the following:

$$q = \beta\ \sigma_s \ln \frac{R_i}{R_o + t} - \sigma_1,$$

where $\beta$ is the coefficient accounting for the influence of an average main stress of the blank material;

$\sigma_s$ is the yield stress of the blank material;

$R_i$ is the blank running radius;

$R_o$ is the punch radius;

t is the wall-thickness of a finished product;

$\sigma_1$ is the stress on the inner edge of the peripheral portion of a blank.

* * * * *